US005517205A

United States Patent [19]

van Heyningen et al.

[11] Patent Number: 5,517,205

[45] Date of Patent: May 14, 1996

[54] TWO AXIS MOUNT POINTING APPARATUS

[75] Inventors: Martin A. K. van Heyningen, Newport, R.I.; John M. Evans, Jr., Brookfield, Conn.

[73] Assignee: KVH Industries, Inc., Middletown, R.I.

[21] Appl. No.: 40,484

[22] Filed: Mar. 31, 1993

[51] Int. Cl.[6] ..... H01Q 3/00

[52] U.S. Cl. ..... 343/765; 343/766; 74/98; 248/183.1

[58] Field of Search ..... 343/711, 713, 343/709, 765, 766, 882; 362/359; 248/183, 184, 278; 74/98; 403/53, 57, 74

[56] References Cited

U.S. PATENT DOCUMENTS

| | | | |
|---|---|---|---|
| 3,166,750 | 1/1965 | Ball . | |
| 3,262,321 | 7/1966 | Moul . | |
| 3,351,946 | 11/1967 | Verge . | |
| 3,374,977 | 3/1968 | Moy . | |
| 3,860,931 | 1/1975 | Pope et al. | 343/709 |
| 3,893,123 | 7/1975 | Bieser | 343/709 |
| 3,968,496 | 7/1976 | Brunvoll | 343/765 |
| 3,999,184 | 12/1976 | Fuss, III | 343/765 |
| 4,069,083 | 9/1986 | Stuhler | 343/709 |
| 4,100,472 | 7/1978 | Mobley | 318/685 |
| 4,143,312 | 3/1979 | Duckworth et al. | 343/709 |
| 4,209,789 | 6/1980 | Snedkerud | 343/765 |
| 4,384,294 | 5/1983 | Crook et al. | 343/709 |
| 4,433,337 | 2/1984 | Smith et al. | 343/765 |
| 4,450,451 | 5/1984 | La Torre et al. | 343/765 |
| 4,490,724 | 12/1984 | Bickman | 343/766 |
| 4,586,050 | 4/1986 | Kuroda et al. | 342/359 |
| 4,596,989 | 6/1986 | Smith et al. | 343/709 |
| 4,612,551 | 9/1986 | Drever | 342/359 |

(List continued on next page.)

FOREIGN PATENT DOCUMENTS

| | | |
|---|---|---|
| 0076978 | 4/1983 | European Pat. Off. . |
| 0142397 | 5/1985 | European Pat. Off. . |
| 62-76902 | 4/1987 | Japan . |
| 63-1102 | 6/1988 | Japan . |
| 64-44608 | 2/1989 | Japan . |
| 1-151305 | 6/1989 | Japan . |
| WO8503811 | 8/1985 | WIPO . |

OTHER PUBLICATIONS

English language abstract of Japanese Patent No. 63–1102 (Yamada).

English language abstract of Japanese Patent No. 64–44608 (Matsuo).

English language abstract of Japanese Patent No. 1–151305 (Takahara).

*Primary Examiner*—Donald Hajec
*Assistant Examiner*—Tan Ho
*Attorney, Agent, or Firm*—Wolf, Greenfield & Sacks

[57] ABSTRACT

An antenna pointing device for use in a satellite tracking system, including a satellite tracking system mounted on a moving body. The tracking system has at least one sensor that generates a signal indicating the orientation of the moving body relative to the satellite. The pointing device includes a base mounted on the moving body, an antenna pointing arm carrying the antenna and a universal joint supported by the base. The pointing arm is rotatably mounted within the universal joint for rotation about first and second control axes, the universal joint being constructed and arranged to enable rotation of the pointing arm through greater than 180 degrees but less than 360 degrees about each of the first and second control axes while suffering no singularities of control. The universal joint is further constructed and arranged so that the orientation of the first control axis varies as the antenna pointing arm is rotated about the second control axis, and the orientation of the second control axis varies as the pointing arm is rotated about the first control axis. The pointing device further includes control means, responsive to the at least one sensor, for rotating the antenna pointing arm about the first and second control axes when the moving body changes its orientation so that the antenna is continuously pointed at the satellite.

49 Claims, 7 Drawing Sheets

U.S. PATENT DOCUMENTS

| | | | |
|---|---|---|---|
| 4,621,266 | 11/1986 | Le Gall et al. | 348/359 |
| 4,630,056 | 12/1986 | Noguchi et al. | 342/357 |
| 4,672,385 | 6/1987 | Prindle | 343/766 |
| 4,692,771 | 9/1987 | Rothbarth et al. | 343/882 |
| 4,696,196 | 9/1987 | Vucevic | 343/765 |
| 4,725,843 | 2/1988 | Suzuki et al. | 342/359 |
| 4,729,253 | 3/1988 | Rosheim | 74/479 |
| 4,803,490 | 2/1989 | Kruger | 342/158 |
| 4,823,134 | 4/1989 | James et al. | 342/359 |
| 4,833,932 | 5/1989 | Rogers | 343/765 |
| 4,841,309 | 6/1989 | Burr | 343/766 |
| 4,920,349 | 4/1990 | Le Gall | 343/709 |
| 4,920,350 | 4/1990 | McGuire et al. | 343/709 |
| 4,953,422 | 9/1990 | Chapman et al. | 248/184 |
| 4,994,815 | 2/1991 | Nakayama | 343/765 |
| 5,025,262 | 6/1991 | Abdelrazik et al. | 343/705 |
| 5,052,637 | 10/1991 | Lipps | 244/3.15 |
| 5,061,936 | 10/1991 | Suzuki | 342/359 |
| 5,077,560 | 12/1991 | Horton et al. | 342/359 |
| 5,153,485 | 10/1992 | Yamada et al. | 318/35 |
| 5,227,806 | 7/1993 | Eguchi | 343/765 |

TWO AXIS MOUNT POINTING APPARATUS

FIELD OF THE INVENTION

This invention relates to a pointing apparatus for pointing a device at a target. More particularly, this invention is directed toward a pointing apparatus utilizing a two axis mount. The pointing apparatus of the present invention is particularly well-suited for use in a target tracking system located on a moving body such as a ship, and can be used to implement a satellite tracking system wherein an antenna is continuously pointed in the direction of a satellite.

BACKGROUND OF THE INVENTION

Satellite communication systems have been developed for transmitting information from a source to a destination. In these communication systems, an information signal is initially transmitted from the source to a geostationary satellite. The signal is received by the satellite, and then retransmitted to the destination. An antenna is utilized at the source to transmit the signal to the satellite, and at the destination to receive the retransmitted signal from the satellite. To ensure that the communication link is maintained, both the transmitting and receiving antennas must be pointed in the direction of the satellite. Geostationary satellites orbit the earth in such a manner that they maintain a constant orientation relative to any particular location on the earth's surface. Therefore, if the source and destination have fixed locations, the antenna pointing direction for each, once established, is essentially fixed. Consequently, for communication systems that have fixed transmitting and receiving locations, the satellite tracking system need not adjust the antenna pointing direction on a continuous basis in order to track the satellite.

Systems have also been developed for establishing a satellite communication link with a mobile body, such as a motor vehicle or a ship. When a satellite tracking system is installed on a ship, an antenna is mounted on the ship for transmitting signals to and receiving signals from a geostationary satellite. The antenna pointing apparatus for a ship-borne tracking system is more complex than for stationary tracking systems because the pointing direction of the antenna, relative to the ship, continuously changes due to various factors associated with the orientation of the ship. As the ship travels from one location to another, it may change its heading direction relative to the earth which causes a corresponding change (yaw) in the desired pointing direction of the antenna relative to the ship. Additionally, as a result of disturbances in the water surface, the ship may pitch and roll, thereby tilting the ship relative to the satellite and requiring that a corresponding change be made in the pointing direction of the antenna relative to the ship in order to keep the antenna pointed in the direction of the satellite.

To maintain continuous communication with the satellite, it is desirable to ensure that, despite variations in heading direction, pitch and roll of the ship, the antenna remains continuously pointed in the direction of the satellite. A number of prior art systems have been developed for controlling the pointing direction of a ship-mounted antenna to compensate for the above-described factors. Many of these systems employ a turntable that is rotatable through 360 degrees about the azimuth axis, and an arm, carrying an antenna at its end, that is mounted on the turntable and is rotatable through 90 degrees about the elevation axis. By rotating the turntable through various degrees of azimuth and adjusting the arm through various degrees of elevation, the antenna pointing system can point the antenna at a satellite located anywhere in the hemisphere above the ship.

In these prior art antenna pointing systems, the turntable is mounted on a stabilized platform that keeps the turntable and the associated elevation arm at a level orientation, despite pitching and rolling of the ship. As a result, the turntable and elevation arm need only be adjusted to compensate for changes in the heading direction of the ship and in the elevation of the satellite in the sky in order to keep the antenna pointed in the direction of the satellite.

The platform can be stabilized either actively or passively. A passively stabilized platform utilizes gyroscopes that physically maintain the platform in a constant level orientation. Alternatively, actively stabilized platforms have been employed that use sensors to detect pitch and roll angles of the ship. These sensors are coupled to motors which drive gears that actively adjust the orientation of the platform relative to the ship to compensate for pitching and rolling thereof. In this manner, the platform is kept at a constant level orientation.

The above-described prior art systems suffer from several disadvantages. First, stabilized platforms, whether passive or active, are costly to implement. Passively stabilized platforms employ gyroscopes which are expensive. Actively stabilized platforms require the following four axes of control: (1) an axis to adjust the orientation of the platform relative to the ship to compensate for pitching of the ship; (2) an axis to adjust the orientation of the platform relative to the ship to compensate for rolling of the ship; (3) an azimuth control axis to adjust the orientation of the antenna to compensate for variations in the heading direction of the ship; and (4) an elevation control axis to adjust the orientation of the antenna to compensate for variations in the elevation of the satellite relative to the horizon. Each axis of control requires bearings, gears and a motor to drive the gears, thereby increasing the overall cost of the system.

A second problem associated with the turntable pointing systems is that a cable that couples the antenna to circuitry for transmitting and receiving signals to and from the satellite may wrap around the base of the system as the turntable is rotated. Since the cable has a finite length, the communication system may have to be periodically shut down to unwrap the cable. Some prior art designs overcome the cable wrap problem by coupling the cable to a slip ring that enables an electrical connection to be maintained with the antenna as the turntable is rotated. Although these designs overcome the cable wrap problem, the use of a slip ring introduces additional disadvantages because slip rings are costly and unreliable.

Other prior art systems have been developed which mount the turntable directly to the ship in an unstabilized manner. As the ship pitches, rolls and changes its heading direction, the turntable is rotated about the azimuth control axis and the elevation arm is adjusted along the elevation axis in an attempt to keep the antenna pointed in the direction of the satellite. Although these prior art systems use only two control axes, they suffer from a singularity of control because, at a particular location in the hemisphere above the antenna pointing apparatus where a satellite may be located, only one axis of control is effective to adjust the antenna pointing direction. For example, when the satellite is positioned directly over the ship, the elevation arm must be 90 degrees from horizontal to point the antenna in the direction of the satellite. As a result, rotation of the turntable about the azimuth control axis merely spins the antenna about this axis and does not alter the pointing direction of the antenna. The singularity of control is undesirable because it results in a lack of precision in the prior art antenna pointing system. The singularity of control complicates the antenna pointing arm adjustments that must be made about the two control axes as the orientation of the ship changes, thereby making it more difficult to keep the antenna pointed in the direction of the satellite.

Accordingly, it is an object of the present invention to provide an improved pointing apparatus.

SUMMARY OF THE INVENTION

In one embodiment of the invention, a pointing apparatus is provided for a target tracking system which is mountable to a moving body. The tracking system has at least one sensor that generates a signal indicating the orientation of the moving body relative to a target. The pointing apparatus includes a base mountable on the moving body, a pointing arm for carrying a device to be pointed in the direction of the target and a universal joint supported by the base. The pointing arm is rotatably mounted within the universal joint for rotation about first and second control axes. The pointing apparatus further includes a control means, responsive to the sensor, for rotating the pointing arm about the first and second control axes when the moving body changes its orientation relative to the target so that the device is continuously pointed in the direction of the target.

In another embodiment of the invention, the universal joint is constructed and arranged so as to enable rotation of the pointing arm through greater than 180 degrees but less than 360 degrees along each of the first and second control axes.

In another embodiment of the invention, the universal joint is constructed and arranged so that the orientation of the first control axis varies as the device is rotated about the second control axis, and so that the orientation of the second control axis varies as the device is rotated about the first control axis.

In another embodiment of the invention, the universal joint is constructed and arranged to have no singularities of control and to enable the device to be pointed at any location in the hemisphere above the moving body.

In another embodiment of the invention, the pointing arm can be rotated from first to second end positions along each control axis, and the universal joint is constructed and arranged so that the pointing arm is orthogonal to both the first and second control axes when it is positioned midway between the first and second end positions along each control axis.

In another embodiment of the invention, the pointing apparatus includes first and second gear assemblies pivotably mounted on the base. The pointing arm is mechanically coupled to the first and second gear assemblies which are respectively constructed and arranged to rotate the pointing arm about first and second control axes.

In another embodiment of the invention, the pointing apparatus includes an antenna and is used to implement a satellite tracking system wherein the pointing apparatus maintains the antenna pointed in the direction in the satellite.

DETAILED DESCRIPTION

For the purpose of illustration, the two axis mount pointing apparatus of the present invention is specifically described herein as being used to implement a satellite tracking system that is mounted on a ship. However, the two axis mount pointing apparatus can also be used to implement a variety of other target tracking systems wherein a particular device is pointed in the direction of a target. For example, the two axis mount apparatus can be used to implement a tracking system for continually pointing a telescope, camera, weapon or other device in the direction of a target so as to track the target. Additionally, the two axis mount apparatus can be mounted on various types of moving bodies, or can be used with a stationary installation.

Figure 1:
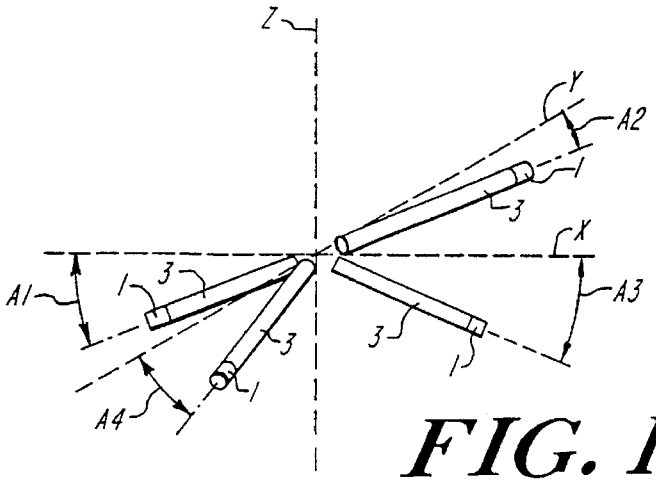
FIG. 1 is a schematic illustration of the pointing apparatus of the present invention.

FIG. 1 is a schematic illustration of the pointing apparatus of the present invention used to implement a satellite tracking system mounted on a ship. The pointing apparatus utilizes a two axis mount in which an antenna 1 is carried by a pointing arm 3 that is mounted to a universal joint (not shown) having two axes of control. The universal joint can be mounted in an unstabilized manner to a moving body such as a ship or vehicle, or it can be mounted to a fixed location on the earth's surface. In FIG. 1, the antenna pointing apparatus is shown as being referenced to a three-dimensional XYZ coordinate system. The plane that includes the X and Y coordinate axes corresponds to the surface of the ship when the ship is level, i.e. its pitch and roll angles are both equal to zero. The two axes of control of the universal joint are hereafter labeled as the X and Y control axes for reference purposes since they can respectively be considered to vary the pointing direction of the antenna along the X and Y coordinate axes when the antenna pointing apparatus is level. FIG. 1 schematically illustrates the pointing arm 3 positioned in four different orientations. As indicated by these four orientations, the pointing arm 3 can be rotated below horizontal along each end of the X control axis (shown by arrows A1 and A3) and along each end of the Y control axis (shown by arrows A2 and A4). As a result, the pointing arm is rotatable through more than 180 degrees along each of the control axes.

Figure 2:
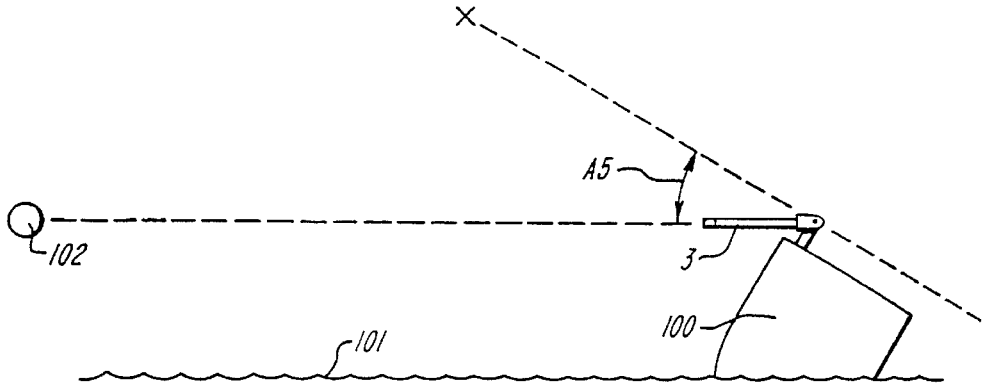
FIG. 2 is a schematic illustration of the pointing apparatus mounted on a ship.

The ability to be rotated through more than 180 degrees is beneficial when the satellite is positioned low in the sky relative to the horizon. When the satellite is positioned in this manner and the ship pitches or rolls away from the satellite, the pointing arm may have to be rotated below horizontal along the X and/or Y control axes in order to keep the antenna pointed in the direction of the satellite as is illustrated in FIG. 2. In FIG. 2, a satellite 102 is positioned low on the horizon. The antenna pointing apparatus is mounted on a ship 100 that is traveling across the surface of the sea 101 and has pitched away from the satellite. As can be seen from FIG. 2, when the satellite 102 is positioned low on the horizon and the ship pitches away from the satellite, the pointing arm must be rotated below horizontal along at least one of the control axes in order to keep the antenna pointed in the direction of the satellite. Therefore, the ability to rotate the pointing arm below horizontal along each control axis is an advantageous feature of the two axis mount pointing apparatus of the present invention.

Figure 3:
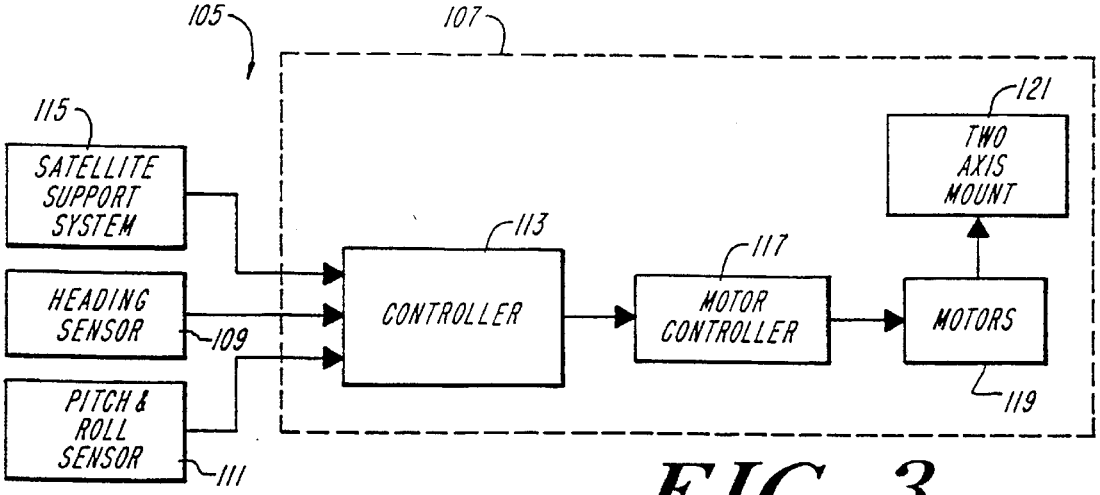
FIG. 3 is a block diagram of a satellite tracking system utilizing the pointing apparatus.
Figure 4:
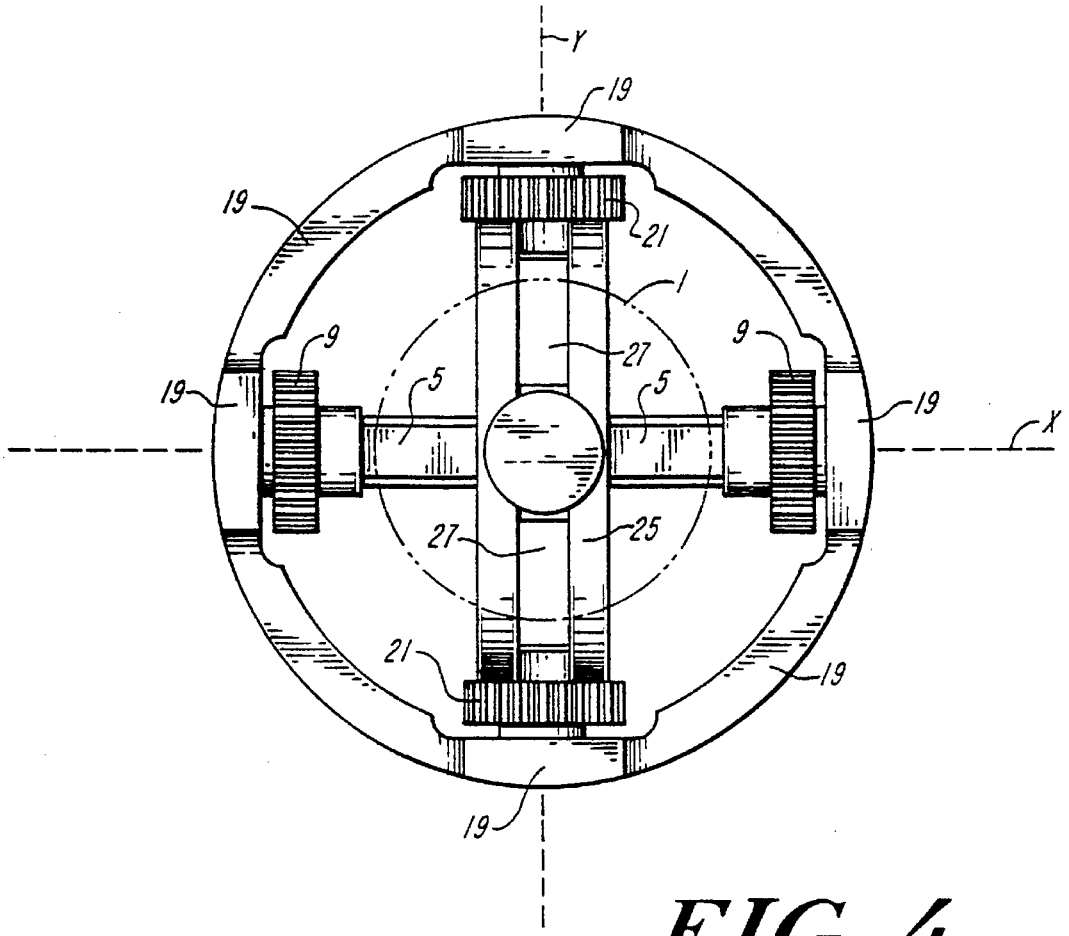
FIG. 4 is a top view of a preferred implementation of the two axis mount utilized in the pointing apparatus.
Figure 5:
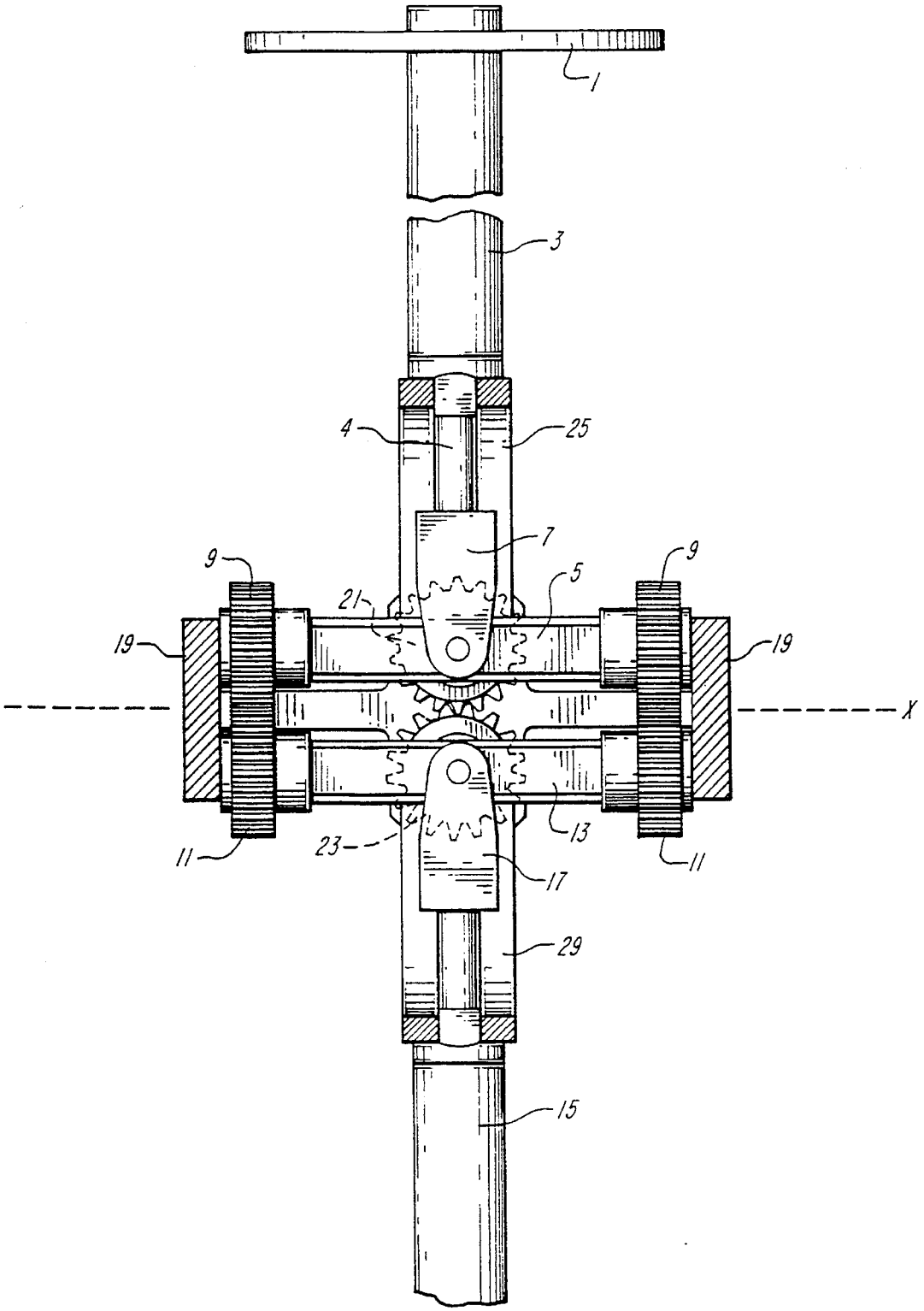
FIG. 5 is a cross-sectional side view of the preferred implementation of the two axis mount apparatus along the X control axis.
Figure 6:
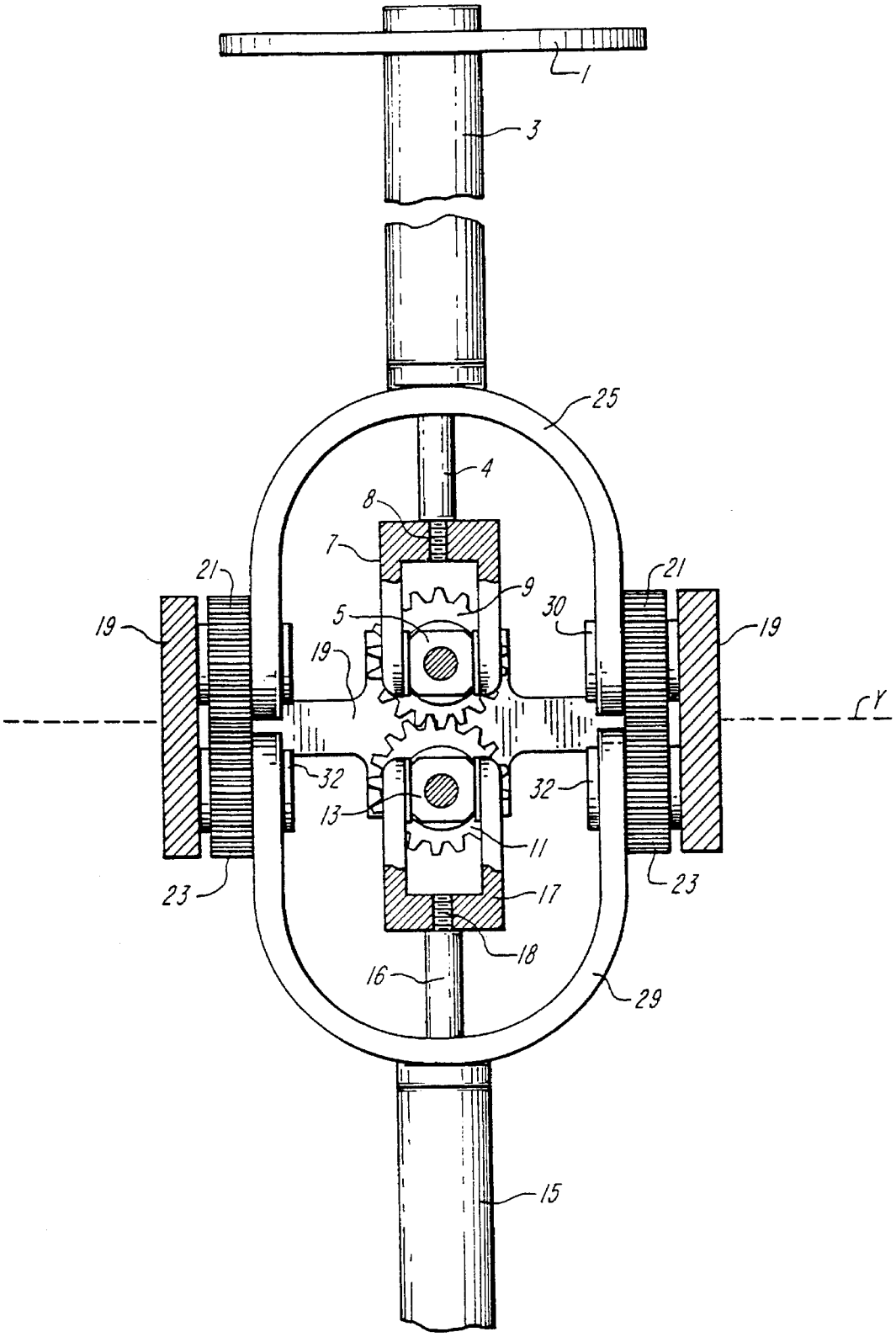
FIG. 6 is a cross-sectional side view of the referred implementation of the two axis mount apparatus along the Y control axis.

FIG. 3 is a block diagram of a satellite tracking system 105 that utilizes the antenna pointing apparatus 107 of the present invention. When the antenna pointing apparatus of the present invention is mounted on a ship, the pointing direction of the antenna must be adjusted to compensate for changes in the heading direction of the ship. As the ship travels from one location to another, it may change its heading direction relative to the earth which causes a corresponding change (yaw) in the orientation of the ship, and the pointing apparatus mounted thereon, relative to the satellite. The satellite tracking system includes a heading sensor 109 that generates a signal indicating the heading direction of the ship. The antenna pointing apparatus 107 utilizes the signal generated by the heading sensor 109 to make corresponding adjustments in the antenna pointing direction as the ship changes its heading direction in a manner that is described below. The heading sensor 109 can be a conventional compass indicating the heading direction of the ship relative to North, or any other sensor that provides similar information.

As stated above, the universal joint is mounted to the ship in an unstabilized manner. Therefore, as the ship pitches and rolls, the universal joint similarly pitches and rolls. To keep the antenna pointed in the direction of the satellite, the pointing direction of the antenna must be adjusted to compensate for pitch and roll of the ship. The satellite tracking system 105 includes a pitch and roll sensor 111 for detecting and generating signals indicating pitch and roll angles of the ship. The pitch and roll sensor may be a vertical gyro mounted on the ship for detecting pitch and roll angles thereof. Alternatively, separate sensors can be used to independently determine the pitch and roll angles of the ship.

The satellite tracking system 105 further includes a satellite support system 115 that provides at least one signal indicating the position of a satellite relative to the ship's location on the earth's surface. The antenna pointing apparatus of the present invention can be used with various satellite communication systems. For example, when the antenna pointing apparatus is used with the INMARSAT satellite system, the satellite support system 115 provides a look-up table that indicates the azimuth and elevation angles of the INMARSAT satellite, in earth coordinates, for various locations on the earth's surface. As an initialization step, a user provides information to the support unit 115 indicating the location of the ship on the earth's surface. The location information need not be provided with precision because the satellite is located so far away from the earth's surface that the azimuth and elevation angles for the satellite are essentially identical for large areas of the earth's surface. The location of the ship can, for example, be established by providing the support system with the longitude and latitude of the ship's position. Once the user indicates the position of the ship on the earth's surface, the support system 115 provides the antenna pointing apparatus with the azimuth and elevation angles of the satellite in earth coordinates, referenced to North, for the ship's current location.

As stated above, the pointing direction of the antenna must be adjusted as the ship pitches, rolls and undergoes changes in its heading direction in order to keep the antenna pointed in the direction of the satellite. The antenna pointing apparatus 107 includes a controller 113. The controller 113 receives the azimuth and elevation angles of the satellite in earth coordinates from the satellite support system 115, and further receives the signals generated by the sensors 109 and 111 respectively indicating the heading direction of the ship, and the pitch and roll angles of the ship. The controller 113 utilizes each of these signals to perform a coordinate transformation of the azimuth and elevation angles in earth coordinates, to azimuth and elevation angles for the satellite in ship coordinates, i.e. azimuth and elevation angles referenced to the orientation of the ship. When the ship is headed due North and is perfectly level on the water's surface, the azimuth and elevation angles in ship coordinates are identical to the azimuth and elevation angles in earth coordinates. However, when the heading direction of the ship varies from North by a given number of degrees, the azimuth angle of the satellite in ship coordinates varies from the azimuth angle in earth coordinates by that given number of degrees. Similarly, when the ship is not perfectly level because it has pitched and/or rolled, the azimuth and/or elevation angles in ship coordinates differ from the angles in earth coordinates. By utilizing the heading direction of the ship and the pitch and roll angles of the ship, the controller 113 transforms the azimuth and elevation angles received form the satellite support system 115 in earth coordinates into azimuth and elevation angles of the satellite in ship coordinates.

The controller 113 can be implemented utilizing a data processor, or it can be implemented with dedicated hardware. In one embodiment of the invention, the controller 113 utilizes an Intel 8051 8-bit microcontroller and an EPROM that stores a control routine to be performed by the microcontroller.

As stated above, the controller 113 performs a coordinate transformation and generates signals indicating the azimuth and elevation angles for the satellite in ship coordinates. These signals are transmitted to a motor controller 117 that controls motors 119 for driving the two control axes of the two axis mount apparatus 121. The motor controller 117 performs a kinematic transform of the azimuth and elevation angles of the satellite in ship coordinates into X and Y motor control signals. The motor control signals are utilized to control motors 119 to adjust the position of the pointing arm along the X and Y control axes of the two axis mount 121 to point the antenna in the direction of the satellite, and to keep it pointed in the direction of the satellite as the ship pitches, rolls and changes heading direction.

As can be seen from the foregoing, the antenna pointing apparatus maintains the antenna pointed at the satellite as the ship changes its heading direction, pitches and/or rolls. As a result, the satellite communication link is maintained with the ship. As described above, the two axis mount apparatus of the present invention can point the antenna at any location in the hemisphere above the ship. As used herein, the phrase "hemisphere above" the ship is intended to describe the range of possible locations at which the satellite can be positioned while being above the earth's horizon as established from the ship's location on the earth's surface. Therefore, locations that are low on the horizon are considered to be in the hemisphere above the ship, even though those locations are not directly over the ship. As can be seen from the foregoing, the antenna pointing apparatus of the present invention can aim the antenna at any location in the hemisphere above the ship while utilizing only two axes of control.

As stated above, the two axis mount apparatus utilizes a universal joint for receiving the pointing arm on which the antenna is carried. The universal joint can be implemented in a number of different ways. For example, the universal joint can be implemented by utilizing a pair of gimballed assemblies. Gimballed assemblies, however, may suffer from a gimbal lock problem because the mounting of a gimballed assembly to the ship may prevent the pointing arm from being uninterruptedly rotated about the azimuth axis because the pointing arm may mechanically interfere with the structure that mounts the gimballed assembly to the ship. The gimbal lock can be overcome through software control by manipulating the control axes of the gimballed assemblies to overcome the lock.

In a preferred embodiment of the invention, a gimballed assembly is not utilized so that the lock problem need not be overcome, thereby simplifying the control routine that manipulates the control axes. Universal joints have been developed that do not utilize gimballed assemblies. For example, U.S. Pat. No. 4,729,253 issued to Rosheim, which is incorporated herein by reference, discloses a universal joint for implementing a robot wrist actuator. Although Rosheim discloses a universal joint, it does not provide any suggestion that the universal joint could be used in a pointing apparatus for mainting a device pointed in the direction of a target.

A preferred universal joint for implementing the two axis mount apparatus is illustrated in FIGS. 4–8. The two axis mount apparatus shown in FIGS. 4–8 has some similarities with the universal joint disclosed by Rosheim but is a simpler apparatus. As stated above, the two control axes of the two axis mount apparatus are arbitrarily designated as the X and Y control axes. The X and Y control axes are shown as dotted lines in FIGS. 4–8. As can be seen from FIGS. 4–8, the two axis mount apparatus is constructed and arranged to allow rotation of the pointing arm through greater than 180 degrees but less than 360 degrees about each control axis. The orientation of the X control axis varies as the pointing arm is rotated about the Y control axis, and the orientation of the Y control axis varies as the pointing arm is rotated about the X control axis. The two axis mount can point to any location in the hemisphere above the moving body and suffers no singularities of control. When the pointing arm is located midway between its end positions along each control axis, it is orthogonal to both the X and Y control axes.

As shown in FIGS. 4–8, the two axis mount includes a base that is mountable to a moving body and an pointing arm for carrying a device such as an antenna. The two axis mount further includes first and second gear assemblies for respectively rotating the pointing arm about the X and Y control axes. The first and second gear assemblies are each pivotably mounted to the base and are mechanically coupled so that rotation of the pointing arm about one of the control axes causes a pivoting of the other gear assembly.

The two axis mount apparatus shown in FIGS. 4–8 includes a pointing arm 3 that carries an antenna 1 and includes a threaded tip 8 (FIG. 6) that is screwed into a clevis 7 to form a connection between the pointing arm and the clevis 7. The clevis 7 is pivotably connected to a rotatable shaft 5 via a pair of pins (not shown). The rotatable shaft 5 is fixedly connected at its ends to a pair of upper X axis gears 9. Each upper X axis gear 9 interlockingly engages a lower X axis gear 11. The lower X axis gears 11 are fixedly connected to opposing ends of a pivotable shaft 13. The pivotable shaft 13 is pivotably connected to a clevis 17 by a pair of pins (not shown). The clevis 17 is fixedly connected to a support arm 15 that includes a threaded tip 18 (FIG. 6) that is screwed into clevis 17, thereby forming a connection between the support arm 15 and the clevis 17.

The X axis gears 9 and 11 are positioned between sides of an outer support member 19 (shown in cross hatching) that is rotatably connected to both ends of the pivotable shaft 13 and both ends of the rotatable shaft 5. The outer support member 19 is also connected to both ends of an upper guide member 25 and a lower guide member 29. The upper Y axis gears 21 are fixedly mounted to opposing ends of the upper guide member 25 and are positioned between the upper guide member 25 and the support member 19. Upper guide member 25 is provided with a slot 27 (shown in FIG. 4) through which a lower portion 4 of the pointing arm passes. The lower Y axis gears 23 are fixedly connected to opposing ends of the lower guide member 29 and are positioned between the lower guide member and the support member 19. The lower guide member 29 has a slot (not shown) through which an upper portion 16 of the support arm 15 passes.

The two axis mount shown in FIGS. 4–8 operates in the following manner. In order to rotate the antenna about the X axis, a motor (not shown) drives the upper X axis gears 9 either clockwise or counterclockwise depending upon the direction of the desired rotation. As stated above, the upper X axis gears are fixedly connected to rotatable shaft 5. Therefore, as the upper X axis gears are driven, the rotatable shaft 5 rotates in the driven direction about the X axis. As the rotatable shaft 5 is rotated about the X axis, the clevis 7 that is attached thereto is similarly rotated about the X axis. Since clevis 7 is fixedly connected to the lower portion 4 of the pointing arm, rotation of the clevis 7 about the X axis causes the lower portion 4 of the antenna arm to be rotated about the X axis. As the lower portion 4 of the antenna pointing arm is rotated about the X axis, the antenna carried by the pointing arm 3 is similarly rotated about the X axis, thereby varying the pointing direction of the antenna along the X axis.

Figure 8:
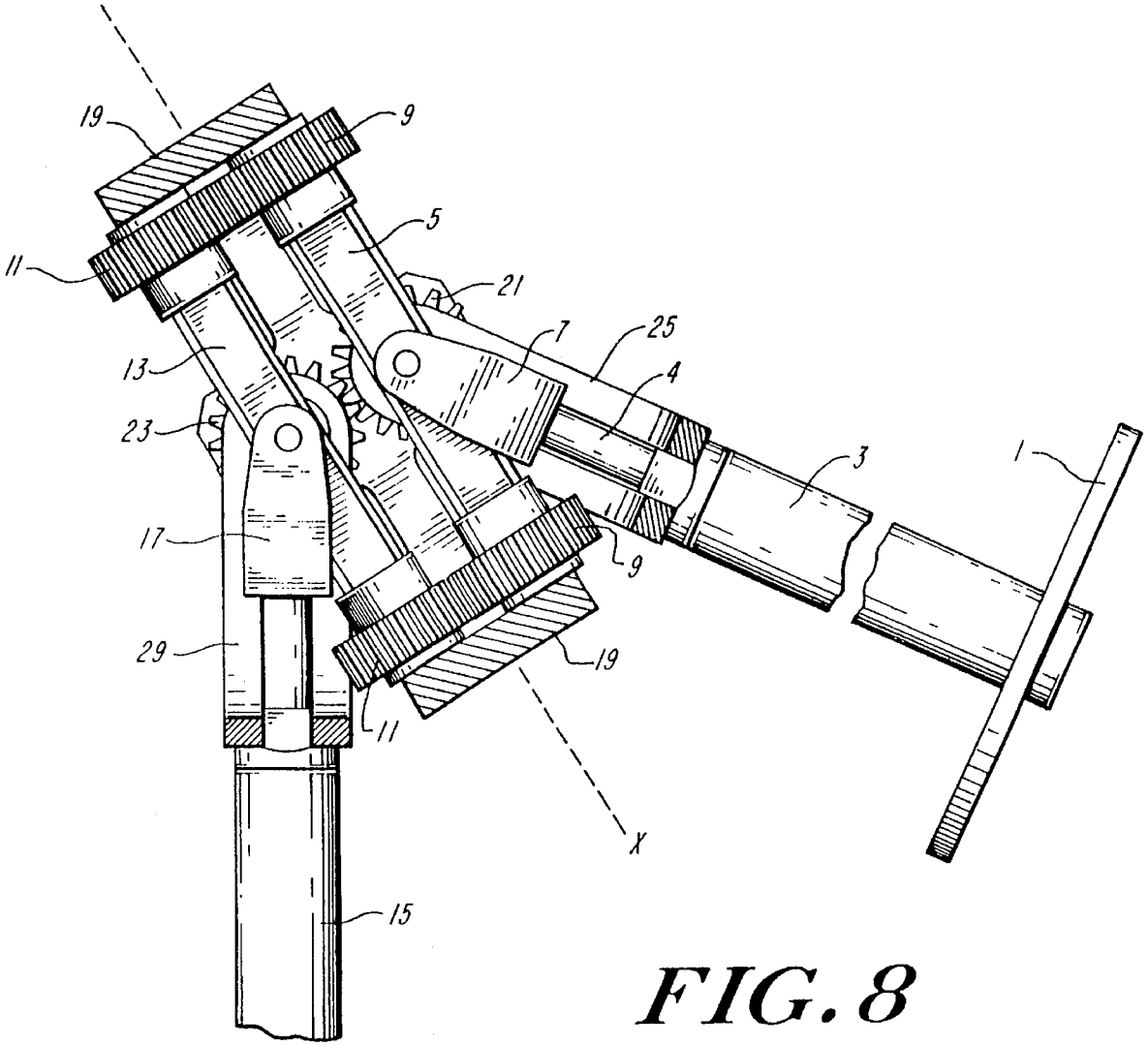
FIG. 8 is a side view of the preferred implementation of the two axis mount apparatus with the pointing arm rotated along the Y control axis.

As the pointing arm is rotated about the X axis, the lower portion 4 of the arm passes through the slot 27 provided in the upper guide member 25. As a result, the antenna arm rotates freely about the X axis through greater than 180 degrees of movement. As the antenna arm is rotated about the X axis, the support member 19 pivots about its connection to the pivotable shaft 13 in the rotation direction of the X axis gears. Since the upper and lower Y axis gears are mounted to the support member 19, the pivoting of the support member 19 about the pivotable shaft 13 causes the Y axis gears to be rotated about the X axis. As a result, the rotation of the pointing arm about the X axis causes a change in the orientation of the Y control axis which becomes inclined as shown in FIG. 8. As can be seen from FIG. 8, the inclination of the Y axis produces a desirable result in that it enables the antenna arm to be rotated below horizontal along the X axis without interfering with the Y axis control gears. The range of motion along the X axis is limited only by the slots provided in the upper and lower guide members 25 and 29. These slots respectively terminate substantially at the upper and lower Y axis gears. The antenna can be rotated about the X axis until the ends of the slots in the upper and lower guide members 25 and 29 respectively contact the lower portion 4 of the pointing arm and the upper portion 16 of the support arm 15. As can be seen from FIG. 8, the pointing arm can be rotated below horizontal along each end of the X control axis so that the pointing arm can be rotated through greater than 180 degrees along the X control axis.

The manner in which the antenna is rotated about the Y control axis will now be described. In order to achieve rotation of the antenna 1 about the Y control axis, a motor (not shown) drives the upper Y axis gears 21 either clockwise or counterclockwise depending upon the direction of the desired rotation. As the upper Y axis gears 21 are rotated, the upper guide member 25 is rotated therewith because each end of the upper guide member 25 is fixedly connected to an upper Y axis gear 21. Since the lower portion 4 of the pointing arm is positioned within the slot 27 in the upper guide member 25, rotation of the upper guide member 25 causes the pointing arm, and consequently the antenna 1 carried thereby, to be rotated about the Y control axis.

Figure 7:
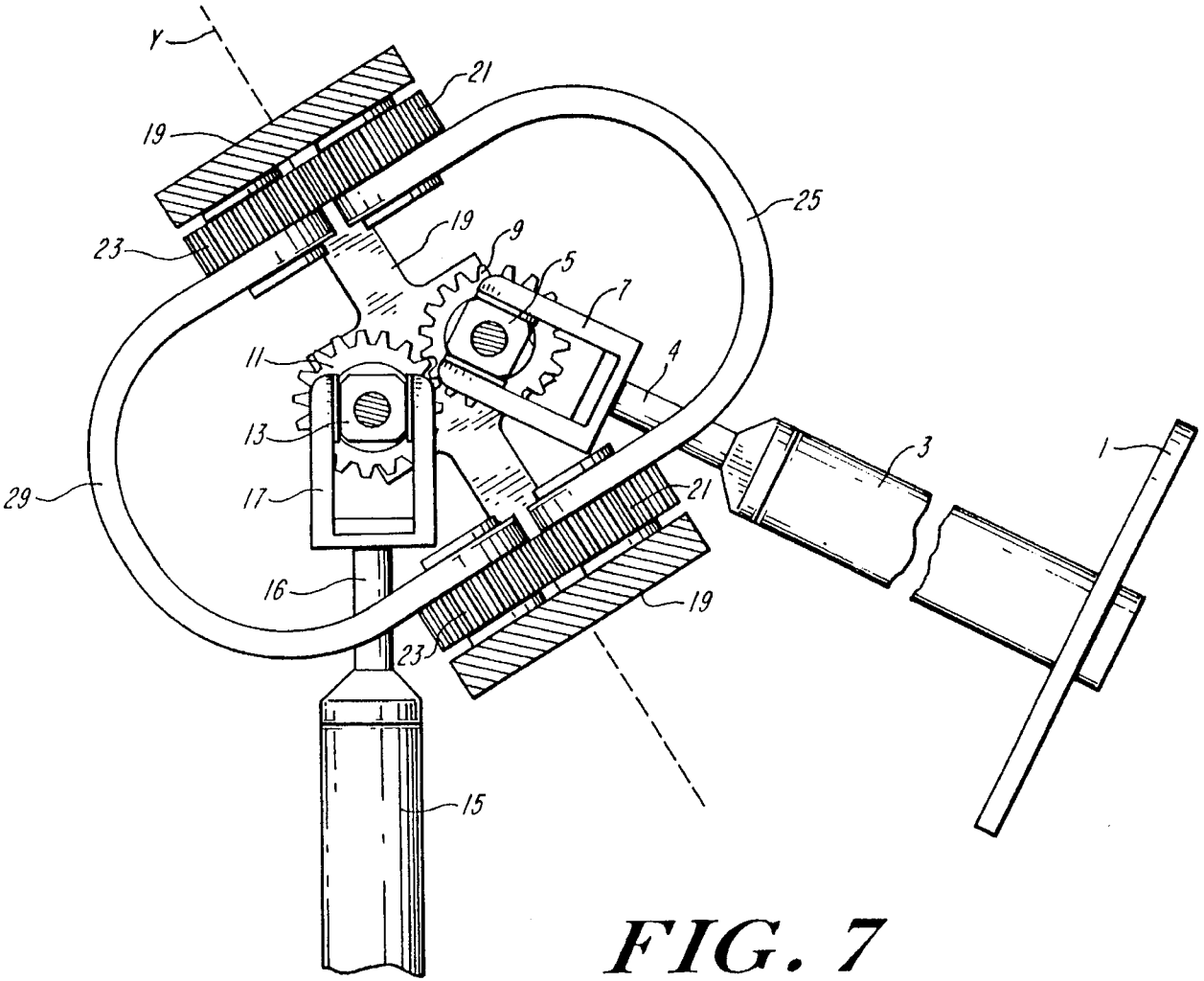
FIG. 7 is a side view of the preferred implementation of the two axis mount apparatus with the pointing arm rotated along the X control axis.

As the pointing arm is rotated about the Y control axis, the support member 19 pivots about its connection to the lower guide member 29 in the direction of rotation of the Y axis gears. Since the support member 19 is connected to both ends of shafts 5 and 13 that respectively support the upper and lower X axis gears, the pivoting of support member 19 about the lower guide member 29 causes the X axis gears to be rotated about the Y axis. As a result, the rotation of the pointing arm about the Y axis causes a change in the orientation of the X control axis which becomes inclined as shown in FIG. 7. The inclination of the X control axis produces a desirable result in that it allows the antenna arm to be rotated below horizontal along the Y control axis without encountering interference from the X axis gears. The range of motion along the Y axis is limited by the pivotal mount between the clevis 17 and the pivotable shaft 13. As the X axis gears are rotated about the Y control axis, the pivotable shaft 13, to which the lower X axis gears are fixedly connected, pivots about its connection to the clevis 17. When the pointing arm is continuously rotated about the Y control axis in one direction, the inclination of the pivotable shaft 13 eventually becomes great enough so that it contacts the clevis 17 to which it is mounted as shown in FIG. 7. This contact inhibits further rotation of the antenna 1 about the Y control axis in that direction.

As can be appreciated from the foregoing, the particular two axis mount apparatus described above allows the pointing arm to be rotated freely through greater than 180 degrees about both the X and Y control axes, and to be pointed at any location in the hemisphere above the apparatus. Additionally, this mount does not use a gimballed assembly and therefore, does not suffer from a gimbal lock problem; the universal joint of the two axis mount is constructed and arranged so that the pointing arm can be moved through a 360 degree path wherein it traces the earth's horizon without encountering mechanical interference from the base. As a result, the pointing arm can be moved through more than a hemisphere of free rotation, even when it is pointed below horizontal. Additionally, the two axis mount does not suffer from any singularities of control because for every location in the hemisphere above the apparatus where a target may be located, two axes of control are available to alter the pointing direction of the antenna or other device. The two axis mount also does not suffer from a cable wrap problem because the pointing arm is not rotated through 360 degrees about either of the control axes. The two axis mount apparatus utilizes a cable (not shown in the figures) to couple the antenna to circuitry for transmitting and receiving signals to and from the satellite. However, the cable hangs freely from the antenna so that it is not disturbed by the two axis mount and does not wrap around the mount as the pointing direction of the arm is altered. The cable is tie wrapped to the mount so that it does not become entangled in the moving parts of the apparatus. The cable is tie wrapped in such a manner that a sufficient service loop is provided to enable the cable to extend between the tie wrap location and every possible antenna position.

Figure 9:
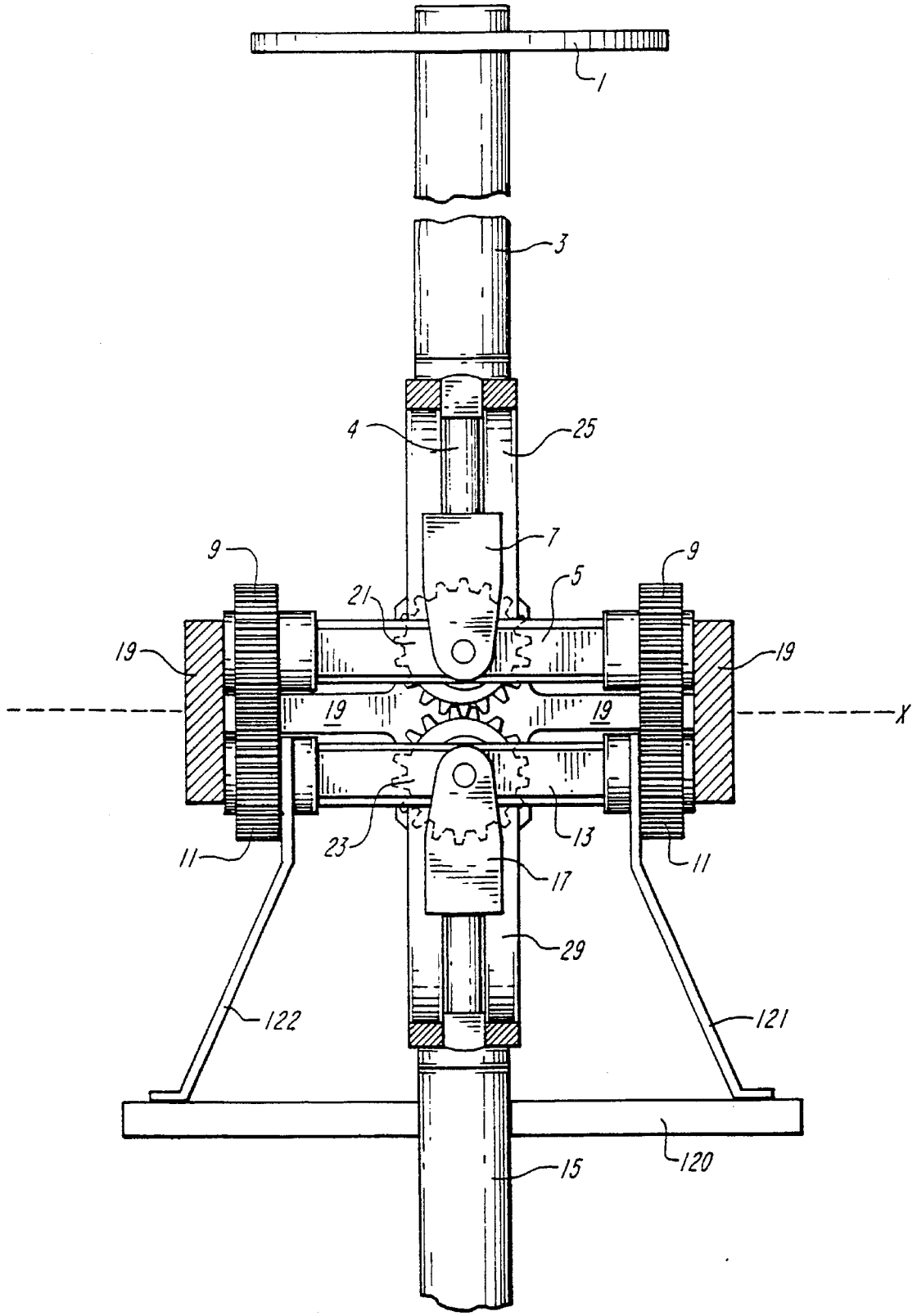
FIG. 9 is a cross-sectional side view, taken along the X axis, of the preferred implementation of the two axis mount apparatus with a counterweight.

FIG. 9 illustrates another embodiment of the pointing apparatus of the present invention. In the embodiment shown in FIG. 9, a counterweight 120 is attached, via struts 121 and 122, to the pivotable support beam 13. The counterweight is a substantially circular piece of material, such as lead or some other metal, that is constructed and arranged such that the torque that it generates on the two axis mount apparatus is substantially equal and opposite to the torque generated on the mount by the pointing arm and the antenna 1 or other device carried by the pointing arm. By balancing the torque generated on the two axis mount by the antenna, the counterweight provides several advantages. When the counterweight is used, less torque is required to drive the motors that adjust the position of the pointing arm along the two control axes. As a result, the motors do not require as much energy to drive the control axes, thereby reducing the amount of energy consumed by the apparatus. Additionally, since less torque is required to drive the control axes, smaller and less expensive motors can be utilized. The counterweight 120 also provides an additional advantage. When the pointing arm is pointing in a particular direction, the antenna generates a torque that would tend to pull the pointing arm downward in the pointing direction. If the ship suddenly pitches or rolls in the pointing direction, additional torque is generated that may exceed the holding torque of the motors. As a result, the pointing arm could be pulled downward so that it no longer points in the direction of the satellite. The counterweight reduces the likelihood of this occurring by balancing the torque generated by the antenna so that the resulting torque generated on the control axes when the ship pitches or rolls is less likely to exceed the holding torque of the motors.

Because of the manner in which the two axis mount controls the pointing direction of the antenna, an axis symmetric antenna should preferably be used in a satellite tracking system that utilizes the antenna pointing apparatus of the present invention. An axis symmetric antenna functions properly as long as it is pointed in the direction of the satellite, and does not have top or bottom portions that must be maintained in a particular relationship. Some antennas are not axis symmetric and only operate properly when oriented such that a top portion is positioned above a bottom portion. A non-symmetric antenna is preferably not used with the two axis mount apparatus because based upon the manner in which the apparatus points the antenna, each portion of the antenna will, for various pointing directions, be positioned such that it is the top, bottom, left or right side of the antenna. Therefore, an axis symmetric antenna should preferably be employed that functions properly in every possible orientation. Alternatively, a non-symmetric antenna can be utilized along with a motor to adjust the orientation of the antenna relative to the pointing arm so as to keep the antenna in the proper orientation as the pointing direction of the arm is altered.

The antenna pointing apparatus of the present invention can be used with a satellite tracking system having a step tracking scheme for increasing the accuracy of the system. Step tracking schemes adjust the antenna pointing direction until the strength of the signal received from the satellite is maximized, thereby ensuring that the antenna is pointed precisely in the direction of the satellite. As stated above with regard to FIG. 3, the antenna pointing apparatus of the present invention can be used with an INMARSAT satellite communication system. The INMARSAT support system 115 includes a device that detects the strength of the signal received from the satellite, and generates a signal to the controller 113 indicating the strength of the received satellite signal. The controller can utilize the strength of the received signal to implement a step tracking scheme. Since the INMARSAT communication system is a digital system, no continuous signal is received from the satellite when information is not being transmitted. Rather, when there is a gap in the transmission of information from the satellite, a signal is sent by the satellite approximately every five seconds to indicate that the communication link is still established. Because the signal received from the satellite is not continuous, step tracking is not done on an instantaneous basis. Rather, the examination of the strength of the received signal is done on an averaging basis over long periods of time, such as over periods of minutes or hours.

A satellite tracking system that utilizes the two axis mount apparatus can utilize a step tracking scheme to adjust the antenna pointing direction in a manner that is independent of the adjustments made in the antenna pointing direction to compensate for changes in the heading direction, pitching and rolling of the ship. As the ship changes its heading direction, pitches or rolls, the antenna pointing apparatus, in the manner described above, adjusts the pointing direction of the antenna so that it is continually pointing in the direction of the satellite. Step tracking can be accomplished by continuously varying the pointing direction of the antenna by slight amounts in both the azimuth and elevation directions, and determining whether each adjustment results in an increase or decrease of signal strength. When the signal strength increases as a result of an adjustment, the system recognizes that the new pointing direction is more accurate than the prior pointing direction and maintains the new pointing direction. However, when the signal strength decreases as the result of an adjustment, the system recognizes that the new pointing direction is less accurate than the prior pointing direction and moves the antenna back to its prior position. As stated above, the step tracking adjustments are made on an averaging basis over relatively long periods of time.

The use of a step tracking scheme is particularly useful when the ship travels over long distances. When the ship travels over a long distance, the azimuth and elevation angles of the satellite relative to the ship's location may differ from those for the location that the user input into the INMARSAT system during initialization. The step tracking scheme adjusts the antenna pointing direction to maximize the received signal strength and as a result, can compensate for changes in the azimuth and elevation angles of the satellite that result when the ship travels over a long distance. As a result, the user need not manually update the ship location in order to maintain the accuracy of the satellite tracking system.

Although the two axis mount apparatus of the present invention has been described above as being particularly useful for implementing a satellite tracking system mounted on a ship, it should be understood that it can also be utilized to implement a satellite tracking system for use on other moving bodies such as motor vehicles. Additionally, the two axis mount apparatus can also be used to implement a satellite tracking system for a stationary installation. A stationary installation may have the capability of tracking different satellites at different times. In a stationary installation, the satellite support system 115 (FIG. 3) provides a look-up table indicating the azimuth and elevation angles for a plurality of satellites that can be tracked. The user provides information to the support unit to select a satellite to be tracked, and the support unit provides the antenna pointing apparatus 107 with the azimuth and elevation angles of the selected satellite referenced to the location of the stationary installation. The antenna pointing apparatus 107 then adjusts the pointing direction of the antenna so that it points in the direction of the selected satellite. The ability of the two axis mount apparatus to point at locations below horizontal is useful for a stationary installation when the satellite being tracked is low on the horizon. Since the two axis mount apparatus can point to locations below horizontal, the mount need not be perfectly level in order to ensure that it can point to locations low on the horizon.

As stated above, the description of the two axis mount pointing apparatus of the present invention as being used to implement a ship-mounted satellite tracking system has been provided for illustratve purposes. It should be understood that the two axis mount pointing apparatus can also be used to implement a variety of other target tracking systems wherein a particular device is pointed in the direction of a target, and that the pointing apparatus can be mounted on various types of moving bodies or can be used with a stationary installation.

It should be understood that various changes and modifications of the embodiments shown in the drawings may be made within the scope of this invention. Thus, it is intended that all matter contained in the above description and shown in the accompanying drawings shall be interpreted in an illustrative and not limiting sense.

What is claimed is:

1. An antenna pointing apparatus for pointing an antenna at a satellite, said antenna pointing apparatus for use in a satellite tracking system mountable to a moving body, the satellite tracking system having at least one sensor that generates a signal indicating the orientation of the moving body relative to the satellite, said antenna pointing apparatus comprising:

a base mountable to the moving body;

an antenna pointing arm;

an antenna mounted to said antenna pointing arm;

a universal joint supported by said base, said antenna pointing arm being mounted to said universal joint and rotatable about first and second control axes, said universal joint being constructed and arranged to allow rotation of said antenna pointing arm through greater than 180 degrees but less than 360 degrees about each of said first and second control axes, whereby the first and second control axes are the only axes about which the antenna pointing arm is rotatable relative to the moving body; and control means, responsive to the signal generated by the at least one sensor, for controlling said universal joint to rotate said antenna pointing arm about said first and second control axes when the moving body changes its orientation relative to the satellite so that said antenna is continuously pointed in the direction of the satellite.

2. An antenna pointing apparatus as claimed in claim 1 wherein said control means is responsive to signals generated by the at least one sensor indicating at least one of a heading direction of the moving body relative to the earth, a pitch angle of the moving body and a roll angle of the moving body.

3. An antenna pointing apparatus as claimed in claim 1 wherein said universal joint is constructed and arranged so that said first control axis is orthogonal to said second control axis.

4. An antenna pointing apparatus as claimed in claim 1 wherein said first and second control axes each have an orientation relative to said base, and wherein said universal joint is constructed and arranged so that said orientation of said first control axis varies as said antenna pointing arm is rotated about said second control axis.

5. An antenna pointing apparatus as claimed in claim 4 wherein said universal joint is constructed and arranged so that said orientation of said second control axis varies as said antenna pointing arm is rotated about said first control axis.

6. An antenna pointing apparatus as claimed in claim 5 wherein said antenna pointing arm can be rotated from first to second end positions along each control axis, and wherein said universal joint is constructed and arranged so that said antenna pointing arm is orthogonal to both said first and second control axes when it is positioned midway between said first and second end positions along each control axis.

7. An antenna pointing apparatus as claimed in claim 5 wherein said base is fixedly mountable to the moving body.

8. An antenna pointing apparatus as claimed in claim 1 wherein said universal joint is constructed and arranged so that said antenna pointing arm can be moved through a 360 degree path wherein it traces the earth's horizon without encountering mechanical interference from said base.

9. An antenna pointing apparatus for pointing an antenna at a satellite, said antenna pointing apparatus for use in a satellite tracking system mountable to a moving body, the satellite tracking system having at least one sensor that generates a signal indicating the orientation of the moving body relative to the satellite, said antenna pointing apparatus comprising:

a base mountable to the moving body;

an antenna pointing arm;

an antenna mounted to said antenna pointing arm;

a universal joint supported by said base, said antenna pointing arm being mounted to said universal joint and rotatable about first and second control axes, said first and second control axes each having an orientation relative to said base, said universal joint being constructed and arranged so that said orientation of said first control axis varies as said antenna pointing arm is rotated about said second control axis, and so that said orientation of said second control axis varies as said antenna pointing arm is rotated about said first control axis; and control means, responsive to the signal generated by the at least one sensor, for rotating said antenna pointing arm about said first and second control axes when the moving body changes its orientation relative to the satellite so that said antenna is continuously pointed in the direction of the satellite.

10. An antenna pointing apparatus as claimed in claim 9 wherein said control means is responsive to signals generated by the at least one sensor indicating at least one of a heading direction of the moving body relative to the earth, a pitch angle of the moving body and a roll angle of the moving body.

11. An antenna pointing apparatus as claimed in claim 9 wherein said universal joint is constructed and arranged so that said first control axis is orthogonal to said second control axis.

12. An antenna pointing apparatus as claimed in claim 9 wherein said antenna pointing arm can be rotated from first to second end positions along each control axis, and wherein said universal joint is constructed and arranged so that said antenna pointing arm is orthogonal to both said first and second control axes when it is positioned midway between said first and second end positions along each control axis.

13. An antenna pointing apparatus as claimed in claim 12 wherein said base is fixedly mountable to the moving body.

14. An antenna pointing apparatus as claimed in claim 9 wherein said universal joint is constructed and arranged so that said antenna pointing arm can be moved through a 360 degree path wherein it traces the earth's horizon without encountering mechanical interference from said base.

15. An antenna pointing apparatus for pointing an antenna at a satellite, said antenna pointing apparatus for use in a satellite tracking system mountable to a moving body, the satellite being positioned in a hemisphere above the moving body, the satellite tracking system having at least one sensor that generates a signal indicating the orientation of the moving body relative to the satellite, said antenna pointing apparatus comprising:

a base mountable to the moving body;

an antenna pointing arm;

an antenna mounted to said antenna pointing arm;

a universal joint supported by said base, said antenna pointing arm being movably mounted to said universal joint, said universal joint being constructed and arranged to point said antenna at any location in the hemisphere above the moving body without any singularities of control; and control means, responsive to the signal generated by the at least one sensor, for moving said antenna pointing arm within said universal joint when the moving body changes its orientation relative to the satellite so that said antenna is continuously pointed in the direction of the satellite.

16. An antenna pointing apparatus as claimed in claim 15 wherein said antenna pointing arm is mounted to said universal joint for rotation about first and second control axes, said first and second control axes each have an orientation relative to said base, and wherein said universal joint is constructed and arranged to allow rotation of said antenna pointing arm through greater than 180 degrees but less than 360 degrees about each of said first and second control axes.

17. An antenna pointing apparatus as claimed in claim 16 wherein said universal joint is constructed and arranged so that said orientation of said first control axis varies as said antenna pointing arm is rotated about said second control axis, and so that said orientation of said second control axis varies as said antenna pointing arm is rotated about said first control axis.

18. An antenna pointing apparatus as claimed in claim 17 wherein said antenna pointing arm can be rotated from first to second end positions along each control axis, and wherein said universal joint is constructed and arranged so that said antenna pointing arm is orthogonal to both said first and second control axes when it is positioned midway between said first and second end positions along each control axis.

19. An antenna pointing apparatus as claimed in claim 15 wherein said control means is responsive to signals generated by the at least one sensor indicating at least one of a heading direction of the moving body relative to the earth, a pitch angle of the moving body and a roll angle of the moving body.

20. An antenna pointing apparatus as claimed in claim 15, wherein said antenna pointing arm is mounted to said universal joint for rotation about first and second control axes, said first and second control axes each have an orientation relative to said base, and wherein said universal joint is constructed and arranged so that said orientation of said first control axis varies as said antenna pointing arm is rotated about said second control axis, and so that said orientation of said second control axis varies as said antenna pointing arm is rotated about said first control axis.

21. An antenna pointing apparatus as claimed in claim 15 wherein said base is fixedly mountable to the moving body.

22. An antenna pointing apparatus as claimed in claim 15 wherein said antenna pointing arm can be rotated from first to second end positions along each control axis, and wherein said universal joint is constructed and arranged so that said antenna pointing arm is orthogonal to both said first and second control axes when it is positioned midway between said first and second end positions along each control axis.

23. An antenna pointing apparatus as claimed in claim 15 wherein said universal joint is constructed and arranged so that said antenna pointing arm can be moved through a 360 degree path wherein it traces the earth's horizon without encountering mechanical interference from said base.

24. An antenna pointing apparatus for pointing an antenna at a satellite, said antenna pointing apparatus for use in a satellite tracking system mountable to a moving body, the satellite tracking system having at least one sensor that generates a signal indicating the orientation of the moving body relative to the satellite, said antenna pointing apparatus comprising:

a base mountable to the moving body;

an antenna pointing arm;

an antenna mounted to said antenna pointing arm;

a first gear assembly pivotably mounted to said base, said antenna pointing arm being mechanically coupled to said first gear assembly, said first gear assembly being constructed and arranged to rotate said antenna pointing arm about a first control axis;

a second gear assembly pivotably mounted to said base, said antenna pointing arm being mechanically coupled to said second gear assembly, said second gear assembly being constructed and arranged to rotate said antenna pointing arm about a second control axis;

said first gear assembly being mechanically coupled to said second gear assembly so that rotation of said antenna pointing arm about said first control axis causes said second gear assembly to be pivoted relative to said base, and so that rotation of said antenna pointing arm about said second control axis causes said first gear assembly to be pivoted relative to said base; and control means, responsive to the signal generated by the at least one sensor, for rotating said antenna pointing arm about said first and second control axes when the moving body changes its orientation relative to the satellite so that said antenna is continuously pointed in the direction of the satellite.

25. An antenna pointing apparatus as claimed in claim 24 wherein said antenna generates torques about said first and second control axes, and wherein said antenna pointing apparatus includes a counterweight supported by said base, said counterweight being constructed and arranged to balance said torques generated by said antenna.

26. An antenna pointing apparatus for pointing an antenna at a satellite, said antenna pointing apparatus for use in a satellite tracking system mountable to a moving body, the satellite tracking system having at least one sensor that generates a signal indicating the orientation of the moving body relative to the satellite, said antenna pointing apparatus comprising:

a base fixedly mountable to the moving body;

a first shaft pivotably mounted to said base;

a pair of first axis mating gears connected to said first shaft;

a second shaft;

a pair of first axis drive gears connected to said second shaft, said first axis drive gears being positioned adjacent said first axis mating gears for engagement therewith;

a housing mechanically coupled to said first and second shafts;

a guide member coupled at opposite ends to said housing, said guide member having a slot formed therein;

a pair of second axis mating gears, each mounted to said housing;

a pair of second axis drive gears, each mounted to said guide member, said second axis drive gears being positioned adjacent said second axis mating gears for engagement therewith;

a first motor coupled to said pair of first axis drive gears, said first motor driving said first axis drive gears for rotation about said first axis mating gears in response to a first control signal;

a second motor coupled to said pair of second axis drive gears, said second motor driving said second axis drive gears for rotation about said second axis mating gears in response to a second control signal;

an antenna pointing arm pivotably mounted to said second shaft so that rotation of said first axis drive gears causes rotation of said antenna pointing arm about a first control axis, said antenna pointing arm passing through said slot so that rotation of said second axis drive gears causes rotation of said antenna pointing arm about a second control axis; and an antenna mounted to said antenna pointing arm;

control means, responsive to the signal generated by the at least one sensor, for generating said first and second control signals to drive said first and second axis drive gears to adjust said position of said antenna pointing arm when the moving body changes its orientation relative to the satellite so that said antenna is continuously pointed in the direction of the satellite.

27. An antenna pointing apparatus as claimed in claim 26 wherein said antenna generates torques about said first and second control axes, and wherein said antenna pointing apparatus includes a counterweight mounted to said housing, said counterweight being constructed and arranged to balance said torques generated by said antenna.

28. An antenna pointing apparatus for pointing an antenna at a selected satellite, said antenna pointing apparatus for use in a satellite tracking system for tracking a plurality of satellites, each satellite being positioned in a hemisphere above said antenna pointing apparatus, the satellite tracking system generating at least one location signal indicating the location of the selected satellite relative to said antenna pointing apparatus, said antenna pointing apparatus comprising:

a base;

an antenna pointing arm;

an antenna mounted to said antenna pointing arm;

a universal joint supported by said base, said antenna pointing arm being movably mounted to said universal joint, said universal joint being constructed and arranged to point said antenna at any location in the hemisphere above the antenna pointing apparatus without any singularities of control; and control means, responsive to the location signal, for moving said antenna pointing arm within said universal joint so that said antenna is pointed in the direction of the selected satellite.

29. An antenna pointing apparatus as claimed in claim 28 wherein said antenna pointing arm is rotatably mounted within said universal joint for rotation about first and second control axes, and wherein said universal joint is constructed and arranged so as to enable rotation of said antenna pointing arm through greater than 180 degrees but less than 360 degrees about each of said first and second control axes.

30. An antenna pointing apparatus as claimed in claim 28, wherein said antenna pointing arm is rotatably mounted within said universal joint for rotation about first and second control axes, wherein said first and second control axes each has an orientation relative to said base, and wherein said universal joint is constructed and arranged so that said orientation of said first control axis varies as said antenna pointing arm is rotated about said second control axis, and so that said orientation of said second control axis varies as said antenna pointing arm is rotated about said first control axis.

31. An antenna pointing apparatus as claimed in claim 28 wherein said antenna pointing arm can be rotated from first to second end positions along each control axis, and wherein said universal joint is constructed and arranged so that said antenna pointing arm is orthogonal to both said first and second control axes when it is positioned midway between said first and second end positions along each control axis.

32. An antenna pointing apparatus as claimed in claim 31 wherein said first and second control axes each have an orientation relative to said base, and wherein said universal joint is constructed and arranged so that said orientation of said first control axis varies as said antenna pointing arm is rotated about said second control axis, and so that said orientation of said second control axis varies as said antenna pointing arm is rotated about said first control axis.

33. An antenna pointing apparatus as claimed in claim 32 wherein said antenna pointing arm is mounted to said universal joint for rotation about first and second control axes, and wherein said universal joint is constructed and arranged to allow rotation of said antenna pointing arm through greater than 180 degrees but less than 360 degrees about each of said first and second control axes.

34. An antenna pointing apparatus for pointing an antenna at a selected satellite, said antenna pointing apparatus for use in a satellite tracking system for tracking a plurality of satellites, the satellite tracking system generating at least one location signal indicating the location of the selected satellite relative to said antenna pointing apparatus, said antenna pointing apparatus comprising:

a base;

an antenna pointing arm;

an antenna mounted to said antenna pointing arm;

a first gear assembly, said antenna pointing arm being mechanically coupled to said first gear assembly, said first gear assembly being constructed and arranged to rotate said antenna pointing arm about a first control axis;

a second gear assembly, said antenna pointing arm being mechanically coupled to said second gear assembly, said second gear assembly being constructed and arranged to rotate said antenna pointing arm about a second control axis;

said first gear assembly being mechanically coupled to said second gear assembly so that rotation of said antenna pointing arm about said first axis causes said second gear assembly to be pivoted relative to said base, and so that rotation of said antenna pointing arm about said second axis causes said first gear assembly to be pivoted relative to said base; and control means, responsive to the location signal, for rotating said antenna pointing arm about said first and second control axes so that said antenna is pointed in the direction of the selected satellite.

35. An antenna pointing apparatus as claimed in claim 34 wherein said antenna generates torques about said first and second control axes, and wherein said antenna pointing apparatus includes a counterweight supported by said base, said counterweight being constructed and arranged to balance said torques generated by said antenna.

36. An antenna pointing apparatus for pointing an antenna at a selected satellite, said antenna pointing apparatus for use in a satellite tracking system for tracking a plurality of satellites, the satellite tracking system generating at least one location signal indicating the location of the selected satellite relative to said antenna pointing apparatus, said antenna pointing apparatus comprising:

a base;

a first shaft pivotably mounted to said base;

a pair of first axis mating gears connected to said first shaft;

a second shaft;

a pair of first axis drive gears connected to said second shaft, said first axis drive gears being positioned adjacent said first axis mating gears for engagement therewith;

a housing mechanically coupled to said first and second shafts;

a guide member coupled at opposite ends to said housing, said guide member having a slot formed therein;

a pair of second axis mating gears, each mounted to said housing;

a pair of second axis drive gears, each mounted to said guide member, said second axis drive gears being positioned adjacent said second axis mating gears for engagement therewith;

a first motor coupled to said pair of first axis drive gears, said first motor driving said first axis drive gears for rotation about said first axis mating gears in response to a first control signal;

a second motor coupled to said pair of second axis drive gears, said second motor driving said second axis drive gears for rotation about said second axis mating gears in response to a second control signal;

an antenna pointing arm pivotably mounted to said second shaft so that rotation of said first axis drive gears causes rotation of said antenna pointing arm about a first control axis, said antenna pointing arm passing through said slot so that rotation of said second axis drive gears causes rotation of said antenna pointing arm about a second control axis;

an antenna mounted to said antenna pointing arm; and control means, responsive to the location signal, for generating said first and second control signals to drive said first and second axis drive gears to adjust said position of said antenna pointing arm so that said antenna is pointed in the direction of the selected satellite.

37. An antenna pointing apparatus as claimed in claim 36 wherein said antenna generates torques about said first and second control axes, and wherein said antenna pointing apparatus includes a counterweight mounted to said housing, said counterweight being constructed and arranged to balance said torques generated by said antenna.

38. An antenna pointing apparatus for pointing an antenna at a selected satellite, said antenna pointing apparatus for use in a satellite tracking system for tracking a plurality of satellites, each satellite being positioned in a hemisphere above said antenna pointing apparatus, the satellite tracking system generating at least one location signal indicating the location of the selected satellite relative to said antenna pointing apparatus, said antenna pointing apparatus comprising:

a base;

an antenna pointing arm;

an antenna mounted to said antenna pointing arm; and pointing means, supported by said base and responsive to the location and selection signals, for rotating said antenna pointing arm about first and second axes of control, said pointing means rotating said antenna pointing arm through greater than 180 degrees but less than 360 degrees about each axis of control, whereby the first and second axes of control are the only axes about which the antenna pointing arm is rotatable relative to the base.

39. An antenna pointing apparatus as claimed in claim 38 wherein each axis of control has an orientation relative to said base, and wherein said pointing means includes means for varying said orientation of said first axis of control when said antenna pointing arm is rotated about said second axis, and for varying said orientation of said second axis of control when said antenna pointing arm is rotated about said first axis of control.

40. A pointing apparatus for pointing a device at a target, said pointing apparatus for use in a tracking system mountable to a moving body, the tracking system having at least one sensor that generates a signal indicating the orientation of the moving body relative to the target, said pointing apparatus comprising:

a base mountable to the moving body;

a pointing arm for carrying the device;

a first gear assembly pivotably mounted to said base, said pointing arm being mechanically coupled to said first gear assembly, said first gear assembly being constructed and arranged to rotate said pointing arm about a first control axis;

a second gear assembly pivotably mounted to said base, said pointing arm being mechanically coupled to said second gear assembly, said second gear assembly being constructed and arranged to rotate said pointing arm about a second control axis;

said first gear assembly being mechanically coupled to said second gear assembly so that rotation of said pointing arm about said first control axis causes said second gear assembly to be pivoted relative to said base, and so that rotation of said pointing arm about said second control axis causes said first gear assembly to be pivoted relative to said base; and control means, responsive to the signal generated by the at least one sensor, for rotating said pointing arm about said first and second control axes when the moving body changes its orientation relative to the target so that the device is continuously pointed in the direction of the target.

41. A pointing apparatus for pointing a device at a target, said pointing apparatus for use in a target tracking system mountable to a moving body, the target tracking system having at least one sensor that generates a signal indicating the orientation of the moving body relative to the target, said pointing apparatus comprising:

a base fixedly mountable to the moving body;

a first shaft pivotably mounted to said base;

a pair of first axis mating gears connected to said first shaft;

a second shaft;

a pair of first axis drive gears connected to said second shaft, said first axis drive gears being positioned adjacent said first axis mating gears for engagement therewith;

a housing mechanically coupled to said first and second shafts;

a guide member coupled at opposite ends to said housing, said guide member having a slot formed therein;

a pair of second axis mating gears, each mounted to said housing;

a pair of second axis drive gears, each mounted to said guide member, said second axis drive gears being positioned adjacent said second axis mating gears for engagement therewith;

a first motor coupled to said pair of first axis drive gears, said first motor driving said first axis drive gears for rotation about said first axis mating gears in response to a first control signal;

a second motor coupled to said pair of second axis drive gears, said second motor driving said second axis drive gears for rotation about said second axis mating gears in response to a second control signal;

a pointing arm for carrying the device, said pointing arm being pivotably mounted to said second shaft so that rotation of said first axis drive gears causes rotation of said pointing arm about a first control axis, said pointing arm passing through said slot so that rotation of said second axis drive gears causes rotation of said pointing arm about a second control axis; and control means, responsive to the signal generated by the at least one sensor, for generating said first and second control signals to drive said first and second axis drive gears to adjust said position of said pointing arm when the moving body changes its orientation relative to the target so that the device is continuously pointed in the direction of the target.

42. A pointing apparatus for pointing a device at a target, said pointing apparatus for use in a target tracking system mountable to a moving body, the target tracking system having at least one sensor that generates a signal indicating the orientation of the moving body relative to the target, said pointing apparatus comprising:

a base;

an pointing arm for carrying the device;

a universal joint supported by said base, said pointing arm being movably mounted to said universal joint, said universal joint being constructed and arranged to point the device at any location in the hemisphere above the moving body without any singularities of control; and control means, responsive to the signal generated by the at least one sensor, for moving said pointing arm within said universal joint when the moving body changes its orientation relative to the target so that the device is continuously pointed in the direction of the target.

43. A pointing apparatus as claimed in claim 42 wherein said pointing arm is rotatably mounted within said universal joint for rotation about first and second control axes, and wherein said universal joint is constructed and arranged so as to enable rotation of said pointing arm through greater than 180 degrees but less than 360 degrees about each of said first and second control axes.

44. A pointing apparatus as claimed in claim 42 wherein said first and second control axes each have an orientation relative to said base, and wherein said universal joint is constructed and arranged so that said orientation of said first control axis varies as said pointing arm is rotated about said second control axis, and so that said orientation of said second control axis varies as said pointing arm is rotated about said first control axis.

45. A pointing apparatus as claimed in claim 42 wherein said pointing arm can be rotated from first to second end positions along each control axis, and wherein said universal joint is constructed and arranged so that said pointing arm is orthogonal to both said first and second control axes when it is positioned midway between said first and second end positions along each control axis.

46. A pointing apparatus as claimed in claim 45 wherein said first and second control axes each have an orientation relative to said base, and wherein said universal joint is constructed and arranged so that said orientation of said first control axis varies as said pointing arm is rotated about said second control axis, and so that said orientation of said second control axis varies as said pointing arm is rotated about said first control axis.

47. A pointing apparatus as claimed in claim 46 wherein said pointing arm is mounted to said universal joint for rotation about first and second control axes, and wherein said universal joint is constructed and arranged to allow rotation of said pointing arm through greater than 180 degrees but less than 360 degrees about each of said first and second control axes.

48. A pointing apparatus for pointing a device at a target, said pointing apparatus for use in a target tracking system mountable to a moving body, the target tracking system having at least one sensor that generates a signal indicating the orientation of the moving body relative to the target, said pointing apparatus comprising:

a base mountable to the moving body;

a pointing arm for carrying the device;

a universal joint supported by said base, said pointing arm being mounted to said universal joint and rotatable about first and second control axes, said universal joint being constructed and arranged to allow rotation of said pointing arm through greater than 180 degrees but less than 360 degrees about each of said first and second control axes, whereby the first and second control axes are the only axes about which the antenna pointing arm is rotatable relative to the moving body; and control means, responsive to the signal generated by the at least one sensor, for controlling said universal joint to rotate said pointing arm about said first and second control axes when the moving body changes its orientation relative to the target so that the device is continuously pointed in the direction of the target.

49. A pointing apparatus for pointing a device at a target, said pointing apparatus for use in a target tracking system mountable to a moving body, the target tracking system having at least one sensor that generates a signal indicating the orientation of the moving body relative to the target, said pointing apparatus comprising:

a base mountable to the moving body;

a pointing arm for carrying the device;

a universal joint supported by said base, said pointing arm being mounted to said universal joint and rotatable about first and second control axes, said first and second control axes each having an orientation relative to said base, said universal joint being constructed and arranged so that said orientation of said first control axis varies as said pointing arm is rotated about said second control axis, and so that said orientation of said second control axis varies as said antenna pointing arm is rotated about said first control axis; and control means, responsive to the signal generated by the at least one sensor, for rotating said pointing arm about said first and second control axes when the moving body changes its orientation relative to the target so that said device is continuously pointed in the direction of the target.

* * * * *

UNITED STATES PATENT AND TRADEMARK OFFICE

CERTIFICATE OF CORRECTION

PATENT NO. : 5,517,205
DATED : May 14, 1996
INVENTOR(S) : Martin A. Kits van Heyningen, et al.

It is certified that error appears in the above-identified patent and that said Letters Patent is hereby corrected as shown below:

On the title page, item [75] Inventors: "Martin A. K. van Heyningen, Newport, R.I.,: John M. Evans, Jr., Brookfield, Conn." should read -- Martin A. Kits van Heyningen, Newport, R.I.; John M. Evans, Jr., Brookfield, Conn.--.

Signed and Sealed this

Fifth Day of November, 1996

*Attest:*

*Attesting Officer*

Bruce Lehman

BRUCE LEHMAN

*Commissioner of Patents and Trademarks*

UNITED STATES PATENT AND TRADEMARK OFFICE

CERTIFICATE OF CORRECTION

PATENT NO. : 5,517,205
DATED : May 14, 1996
INVENTOR(S) : Martin A. Kits van Heyningen et al.

It is certified that error appears in the above-identified patent and that said Letters Patent is hereby corrected as shown below:

Title page,
Item [75], Inventors, "Martin A. Kits van Heyningen, Newport, R.I.,: John M. Evans, Jr., Brookfield, Conn." should read -- Martin A. Kits van Heyningen, Newport, R.I.; John M. Evans, Jr., Brookfield, Conn. --.

This certificate supersedes Certificate of Correction issued November 5, 1996.

Signed and Sealed this

Nineteenth Day of November, 2002

*Attest:*

*Attesting Officer*

JAMES E. ROGAN
*Director of the United States Patent and Trademark Office*